US005799884A

United States Patent [19]

Alavi

[11] Patent Number: 5,799,884

[45] Date of Patent: Sep. 1, 1998

[54] UNIVERSAL SHREDDER

[76] Inventor: Kamal Alavi, 100 I.H. 45 North, Box 118, L.P. Tower, Conroe, Tex. 77301

[21] Appl. No.: 837,719

[22] Filed: Apr. 22, 1997

[51] Int. Cl.[6] ..... B02C 18/06

[52] U.S. Cl. ..... 241/27; 241/243; 241/260.1

[58] Field of Search ..... 241/243, 260.1, 241/291, 27

[56] References Cited

U.S. PATENT DOCUMENTS

| | | | |
|---|---|---|---|
| 4,938,426 | 7/1990 | Koenig | 241/222 |
| 5,356,054 | 10/1994 | Loppoli et al. | 241/260.1 X |
| 5,562,257 | 10/1996 | Graveman et al. | 241/190 |
| 5,601,239 | 2/1997 | Smith et al. | 241/29 |

FOREIGN PATENT DOCUMENTS

| | | | |
|---|---|---|---|
| 406114284 | 4/1994 | Japan | 241/260.1 |
| 406142545 | 5/1994 | Japan | 241/260.1 |
| 2227955 | 8/1990 | United Kingdom | 241/260.1 |
| 8303444 | 10/1983 | WIPO | 241/260.1 |

*Primary Examiner*—John M. Husar
*Attorney, Agent, or Firm*—Madan & Morris, PLLC

[57] ABSTRACT

The present invention is a universal shredder for shearing and cutting bulk material into pieces of a predetermined size. The apparatus has rotating shearing members that pull the bulk material down between the shearing members and shearing it into sheared pieces. Grooves formed by helically-shaped members extending from the bodies of the shearing members carry the sheared material downward to a main cutting member where the sheared material is cut by cutting teeth removably attached to the helically-shaped members as the cutting teeth pass through notches in the main cutting member. The cut pieces fall or are pushed through the notches in the main cutting member and pass through apertures in a screen positioned beneath the shearing members. The size of the apertures can be adjusted by moving the screen which is supported by a series of parallel ribs with lugs attached in a pattern that matches the pattern of the apertures of the screen.

20 Claims, 6 Drawing Sheets

UNIVERSAL SHREDDER

BACKGROUND OF THE INVENTION

1. Field of the Invention

This invention relates generally to shredders and cutters and more particularly to shredders with integrated, adjustable cutters.

2. Background of the Invention

To process bulk material, it is first necessary to get the material into pieces of a desirable size. If the material is to be recycled, there are certain methods, such as compacting and shredding with different methods like hammer milling, which need to be avoided because of the desirability of having non-pulverized and non-compressed material to make the recycling process more efficient.

The material reaches the processing plant in various sizes and shapes. It is desirable to reduce this material to pieces that are of a somewhat uniform size that is easy to manipulate and process. Materials that are especially valuable for reprocessing and recycling are metal from automobiles and washing machines, white goods, tires, electronic scrap, etc.

Some prior art uses an arrangement that forces the bulk material between rotating, overlapping members which shear the material into strips. The strips are then processed by other means into the desired size. There are several drawbacks to this method including the problem that the bulk material, especially of automobiles, does not tear well and, therefore, it is difficult to get pieces of a desired, uniform size.

Another problem with existing techniques is that the apparatus that have cutting blades do not have easy ways to replace worn parts. This means that the apparatus must be disassembled and new cutters welded into place. In hammer milling, the hammer mill rotates at a very high speed (ex. 1500 rpm). At this speed more power is needed to operate the hammer mill and the wear on the hammer and other parts is very high. The material in the hammer mill also gets very hot which produces emission problems.

Other concerns with the prior art include the amount of torque that is concentrated on the cutting member which causes the parts to fail and the amount of energy that is required to drive this type of apparatus.

SUMMARY OF THE INVENTION

This invention is an apparatus for shearing and cutting bulk material into pieces of a desired size in a single operation which includes a housing, at least two parallel shearing members in the housing that are rotated about a horizontal axis by independent motors and that have helically-shaped member extending from central bodies forming continual grooves along the bodies, spaced-apart cutting teeth removably attached to the helically-shaped members, a main cutter with spaced-apart notches on each side where the cutting teeth of the shearing members pass through as they cut the material, side cutters with spaced-apart notches for the cutting teeth to pass through, a screen with apertures in a known pattern, a screen support with removably attached lugs that are positioned in the same pattern as the apertures and a screen adjustment mechanism that allows the screen to move back and forth such that the lugs close off portions of the corresponding apertures until the apertures are of the desired size.

BRIEF DESCRIPTION OF THE DRAWINGS

For a detailed understanding of the present invention, references should be made to the following detailed description of the preferred embodiment, taken in conjunction with the accompanying drawings, in which like elements have been given like numerals, and wherein.

DETAILED DESCRIPTION OF THE PREFERRED EMBODIMENT

Figure 1:
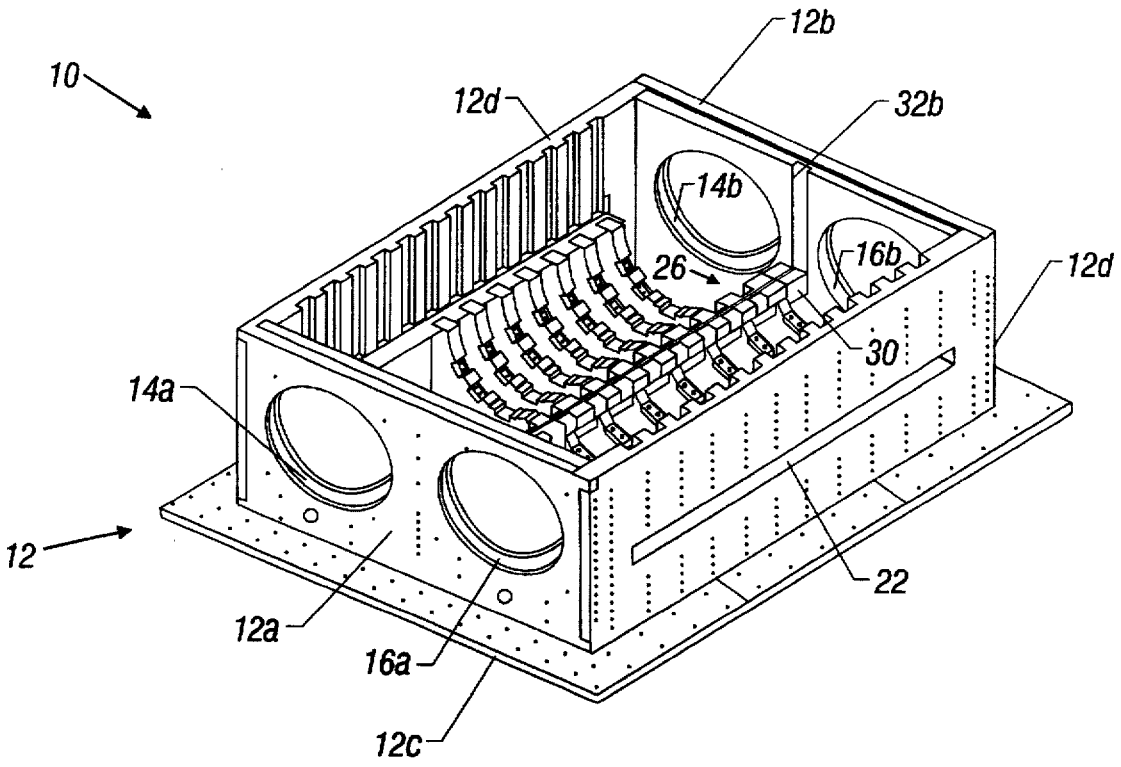
FIG. 1 is a perspective view of the housing and part of the screen assembly of the present invention.

FIG. 1 is a perspective view of a portion of a universal shredder 10 (see also FIG. 2 and FIGS. 3A–C) of the present invention. In the preferred embodiment, a housing 12 includes a front plate **12*a*, a back plate 12*b*, a bottom plate 12*c* and two side plates 12*d*. The plates 12*a–d*** are attached such that they form a boxlike structure with an open top.

Figure 2:
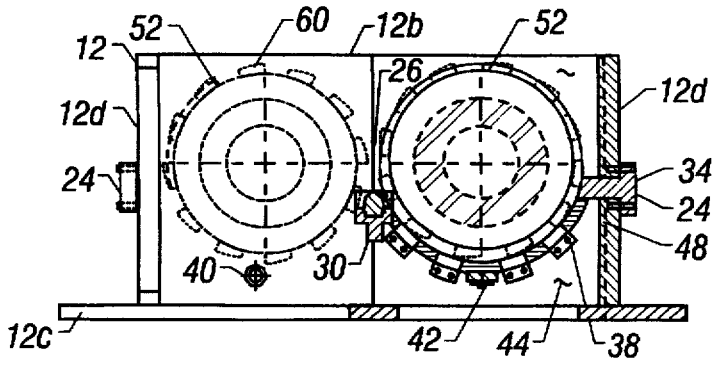
FIG. 2 is a front, partial cross-sectional view of the present invention showing the interrelationship of the shearing members, the main cutter, the side cutters and the screen assembly.
Figure 3A:
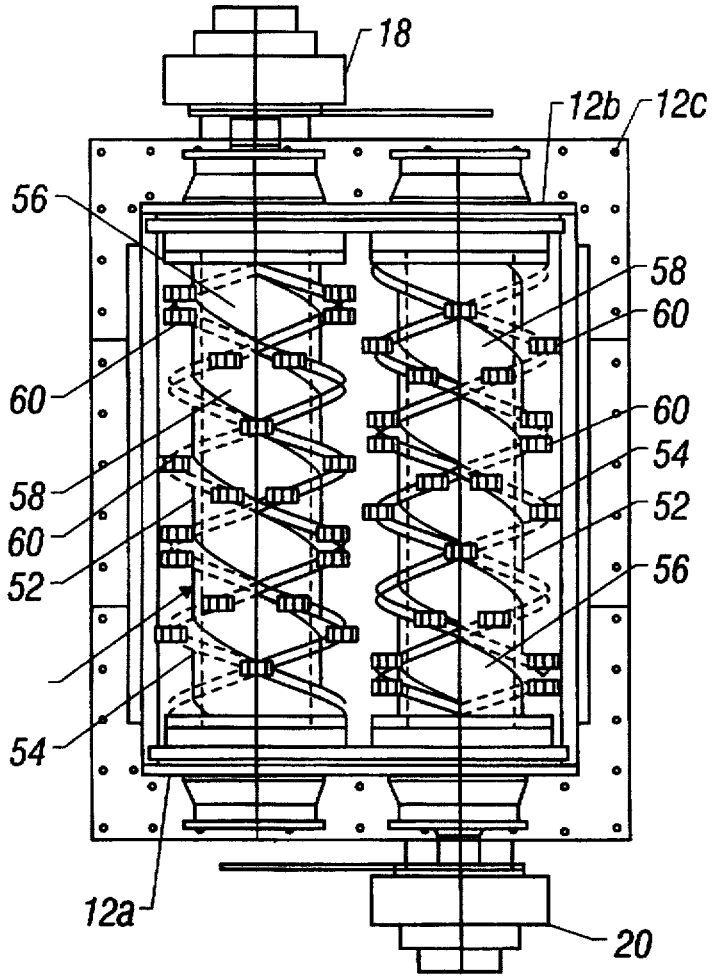
FIGS. 3A–3C are top, front and side views, respectively, of the present invention showing the placement of the shearing members and the motors.
Figure 3B:
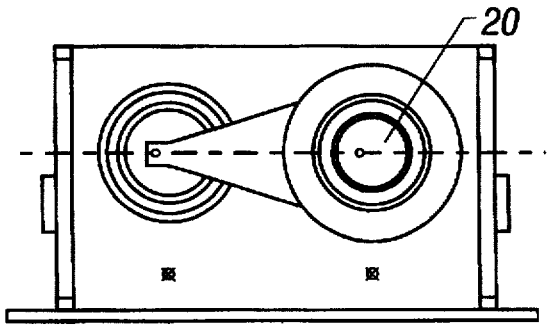
Figure 3C:
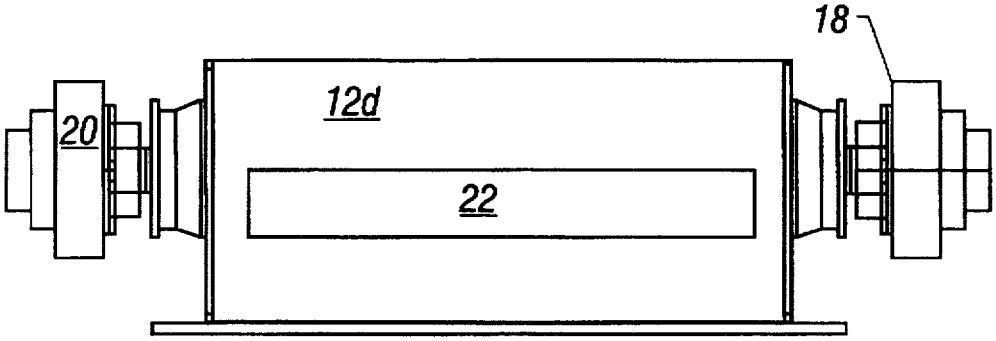

The front plate **12*a* has a pair of apertures 14*a* and 16*a* and the back plate 12*b* has corresponding pairs of apertures 14*b* and 16*b* for mounting of motors 18 and 20 (see FIG. 3C). The side panels 12*d* each have an apertures 22 for mounting side cutters 24** (see FIG. 2).

A main cutter 26 with main cutter blades 28 is positioned in a main cutter support 30 which is installed in grooves **32*a–b* in the front and back plates 12*a–b*. Side cutters 24 (see FIG. 2) with side cutter blades 34 are positioned in apertures 22 in the side plates 12d**.

A screen assembly 36 (see FIGS. 1, 2, 4 and 5A–5B) is installed in the bottom of the housing 12 (see FIG. 2) and includes a screen 38 (FIG. 2 and 5) which is attached to a screen adjustment assembly 40 and positioned on a screen support structure 42 (FIG. 1–2 and 4) having a plurality of ribs 44. The screen 38 has a plurality of apertures 46 (see FIG. 5A) that have corresponding lugs 48 (see FIG. 1) attached to the screen support structure 42. The apertures 46 are partially closed by the corresponding lugs 48 when the screen 38 is moved via the screen adjustment assembly 40 to provide a method of varying the size of the pieces of material (not shown) that can fit through the apertures 46.

In the preferred embodiment, the screens 38 are rectangular and contoured (FIGS. 2, 5A, 5B) to conform to the shape of shearing members 52 (FIG. 2) which are described below.

Figure 4:
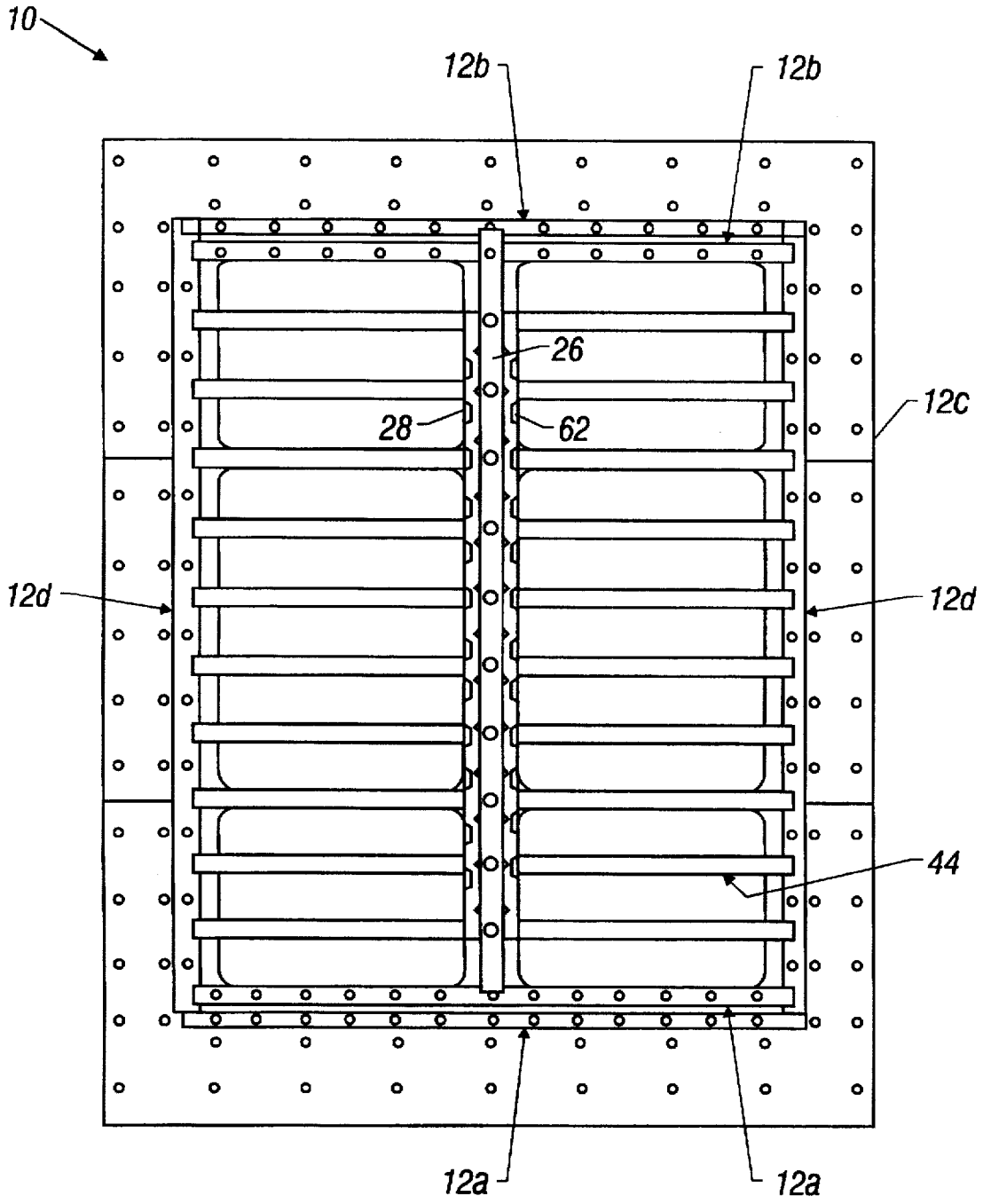
FIG. 4 is a top view of the invention showing the screen support ribs with respect to the housing and the main cutter.
Figure 5A:
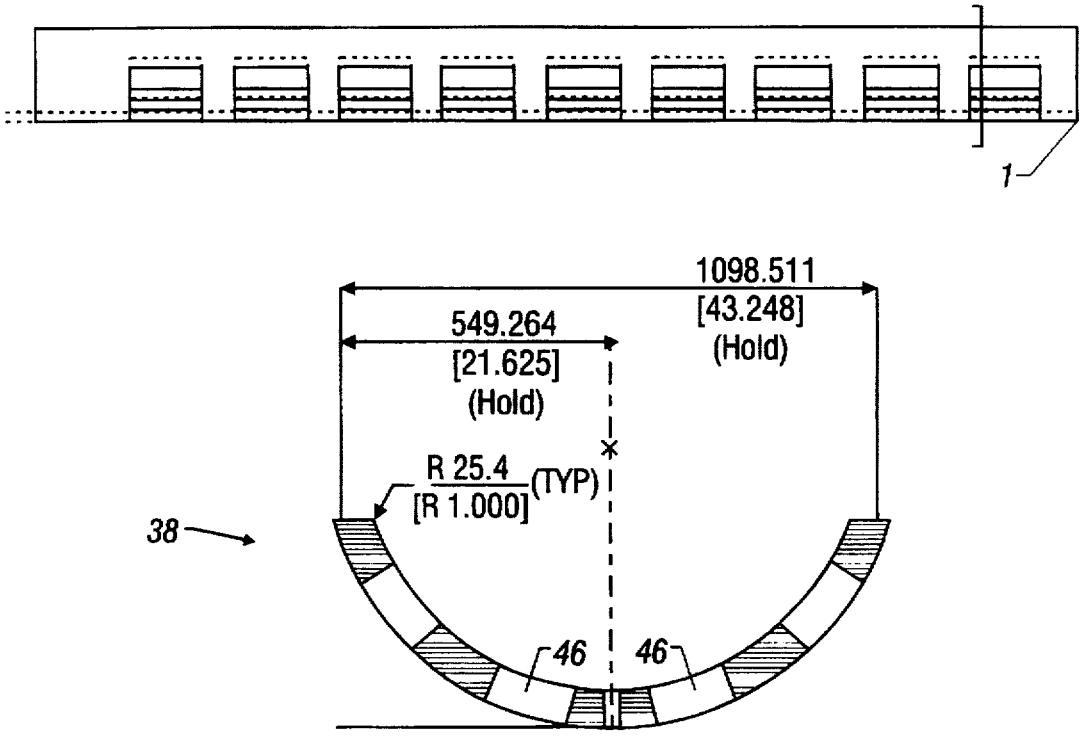
FIGS. 5A–5B are a front cross-sectional view and a top view, respectively, of the screen of the present invention
Figure 5B:
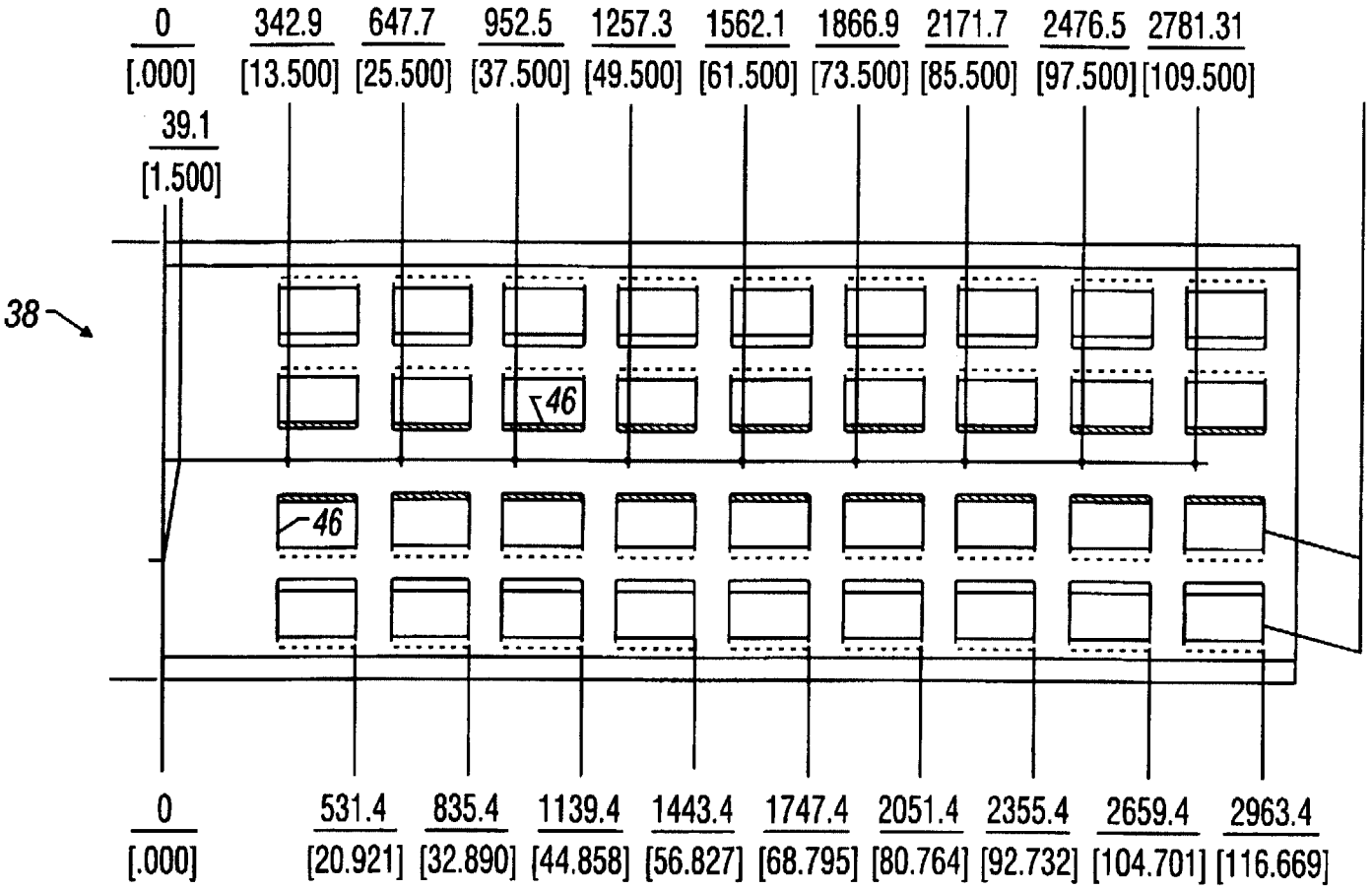

FIG. 4 is a top view of the screen support structure 42 and shows the ribs 44 which, in the preferred embodiment, are approximately parallel and are installed in grooves 50 in the side plates **12*d* of the housing 12 to provide additional support for the screen 38**.

As shown in the partial cross-sectional view of FIG. 2 and the top view of FIG. 3A, the preferred embodiment uses two shearing members 52. The shearing members 52 are attached to the housing 12 through apertures **14*a–b* and 16*a–b* (FIG. 1). Each shearing member 52 is a cylindrically-shaped mass rotatable about a horizontal axis and has a helically-shaped member 54 extending from a central body 56 which forms a continual groove 58 along the body 56**.

A plurality of cutting teeth 60 are removably attached in a specific profile to the top of the helically-shaped members 54. The pattern is determined by the location of notches 62 in the main cutter 26 and the notches 64 in the side cutters 24 (FIG. 3A). The preferred embodiment has the notches 62–64 positioned such that adjacent cutting teeth 60 of a shearing member 52 pass through adjacent notches 62 in the main cutter 26 and then through adjacent notches 64 in the respective side cutter 24. The cutting teeth 60 on the other shearing member 52 pass through notches 62 on the opposite side of the main cutter 26 but in a pattern that staggers the passage of the cutting teeth 60 of the two shearing members 52 such that cutting teeth 60 do not pass through notches 62 and notches 64 that are directly opposite at the same time.

A first motor 18 is attached to one of the shearing members 52 and a second motor 20 is attached to the other shearing member 52 (FIG. 3A–C) to provide independent control of the two shearing members 52.

In the preferred embodiment, motors 18–20 rotate the shearing members 52 towards each other such that the bulk material (not shown) that is input to the shredder 10 from the top is grabbed by the shearing members 52 and pulled downwards. As the material is pulled, it is sheared into elongated pieces that are forced into the grooves 58 of the shearing members 52 and carried to the main cutter 26. As the cutting teeth 60 reach the notches 62 in the main cutter 26, they cut through the material and force it through the notches 62 to the screen 38 below. If the cut pieces (not shown) are small enough, they pass through the apertures 46 in the screen 38. If the cut pieces are too large, they continue to move along with the shearing member 52 and are cut again as they are pushed against the side cutters 24 and cut by the upward swing of the cutting teeth 60 of the shearing members 52.

The cut material falls through the screen 38 and collects at the bottom of the shredder 10. Various methods known in the industry can be used to remove the material from the shredder 10 such as a sliding or pivoting door (not shown).

The cutting teeth 60 are removably attached to the helically-shaped members 54 of the shearing members 52 to facilitate their replacement when they become worn. The lugs 48 in the screen assembly 36 also are removably attached to facilitate replacement for varying sized lugs and replacement for worn parts.

While the foregoing disclosure is directed to the preferred embodiments of the invention, various modifications will be apparent to those skilled in the art. It is intended that all variations within the scope and spirit of the appended claims be embraced by the foregoing disclosure.

I claim:

1. An apparatus for shearing and cutting bulk material into pieces of a desired size in a single operation, comprising:

(a) a housing;

(b) at least two shearing members in said housing, wherein:

(i) each said shearing member is rotatable about a horizontal axis;

(ii) each said shearing member has a helically-shaped member extending from a central body forming a continual groove along the body; and (iii) each said helically-shaped member has a plurality of spaced-apart cutting teeth attached thereto;

(c) at least one power device for rotating the shearing members;

(d) a main cutter comprising an elongated member with spaced-apart notches on each side for allowing the cutting teeth of the shearing members to pass therethrough, wherein said main cutter is positioned parallel to and between the shearing members; and (e) wherein the bulk material is sheared by the rotating action of the shearing members into sheared pieces which are passed into the grooves and transported to the main cutter, wherein the cutting teeth cut the sheared pieces and force the cut pieces through the notches.

2. The apparatus of claim 1, wherein the bottom plate has at least one opening therethrough for passage of the cut pieces.

3. The apparatus of claim 1, wherein the bottom plate has a moveable door for removal of the cut pieces.

4. The apparatus of claim 1, wherein the housing comprises a bottom, two sides, a front and a back plate, wherein the plates are connected together to form a boxlike structure with an open top.

5. The apparatus of claim 1, wherein the shearing members are approximately cylindrical.

6. The apparatus of claim 1, wherein the shearing members are approximately parallel to each other.

7. The apparatus of claim 1, wherein the cutting teeth are spaced such that they pass through the notches in the main cutter at staggered times thereby reducing the energy required to rotate the shearing members.

8. The apparatus of claim 1, further comprising a side cutter comprising an elongated member with spaced-apart notches for allowing the cutting teeth of the shearing member to pass therethrough, wherein said side cutter is attached to the housing parallel to the shearing member.

9. The apparatus of claim 8, further comprising a second side cutter positioned opposite the first side cutter such that one of the shearing members cooperates with the first side cutter and the other shearing member cooperates with the second side cutter.

10. The apparatus of claim 1, further comprising a screen assembly having a screen positioned beneath the shearing members and having apertures of a predetermined size for the passage of cut pieces of the desired size.

11. The apparatus of claim 10, wherein the screen assembly further comprises a screen support assembly for supporting the screen.

12. The apparatus of claim 11, wherein the screen support assembly comprises a plurality of parallel ribs attached to the housing.

13. The apparatus of claim 12, wherein the apertures in the screen are positioned in a predetermined pattern.

14. The apparatus of claim 13, wherein the screen support assembly further comprises a plurality of lugs attached to the plurality of ribs, wherein the plurality of lugs are positioned in the same pattern as the plurality of apertures in the screen.

15. The apparatus of claim 14, wherein the screen assembly further comprises a screen adjustment assembly attached to the screen for moving the screen from one position through a series of positions causing each of the plurality of lugs to close off a portion of its corresponding aperture in the screen.

16. The apparatus of claim 1 wherein the at least one motor comprises two motors adapted for independently rotating the shearing members.

17. A method for shearing and cutting bulk material into pieces of a desired size in a single operation, comprising:

(a) feeding the bulk material between two counter-rotating shearing members located in a housing;

(b) shearing the bulk material into sheared pieces between the counter-rotating shearing members and into grooves located on the shearing members and thence to a main cutter located between the two counter-rotating shearing members; and (c) cutting the sheared pieces between cutting teeth on the counter-rotating members and the main cutter.

18. The method of claim 17 further comprising rotating the two counter-rotating shearing members independently by two power devices.

19. The method of claim 17 wherein the main cutter is stationary.

20. The method of claim 17 further comprising passing the cut and sheared pieces through a screen.

* * * * *